United States Patent [19]

Burger et al.

[11] 4,421,024

[45] Dec. 20, 1983

[54] PRINTING PLATE ATTACHMENT SYSTEM

[75] Inventors: Rainer Burger, Augsburg; Werner Kleininger, Neusass, both of Fed. Rep. of Germany

[73] Assignee: M.A.N.-ROLAND Druckmaschinen Aktiengesellschaft, Offenbach am Main, Fed. Rep. of Germany

[21] Appl. No.: 369,882

[22] Filed: Apr. 19, 1982

[30] Foreign Application Priority Data

Apr. 25, 1981 [DE] Fed. Rep. of Germany ..... 3116506

[51] Int. Cl.[3] ..... B41F 27/12

[52] U.S. Cl. ..... 101/415.1

[58] Field of Search ..... 101/415.1, 378, 382; 29/117, 118; 51/364–371, 374, 375, 387, 275, 277; 24/136 R, 136 L; 242/74, 74.1, 74.2

[56] References Cited

U.S. PATENT DOCUMENTS

| | | | |
|---|---|---|---|
| 1,900,986 | 3/1933 | Gietz | 101/415.1 |
| 1,976,565 | 10/1934 | Kauffmann | 51/369 |
| 2,229,059 | 1/1941 | Ditty et al. | 101/415.1 |
| 2,948,487 | 8/1960 | Locklin | 242/74.2 |
| 3,410,211 | 11/1968 | Gruing | 101/415.1 |
| 4,277,164 | 7/1981 | Fortmann | 101/415.1 |

FOREIGN PATENT DOCUMENTS

| | | | |
|---|---|---|---|
| 1012081 | 12/1965 | United Kingdom | 101/415.1 |

*Primary Examiner*—Paul T. Sewell
*Assistant Examiner*—David A. Wiecking
*Attorney, Agent, or Firm*—Frishauf, Holtz, Goodman & Woodward

[57] ABSTRACT

To attach a printng plate (2) to a plate cylinder (1) having a groove therein, the groove has converging inner walls (10, 11) and a two-part attachment clamping wedge (5, 6) is provided, the clamping wedge being spring loaded to clamp an end portion (A) of the plate (2) between one part (6) of the wedge and an adjacent side wall (10), the other end portion (E) of the plate (2) being clamped between the two parts (5, 6). The parts have, in cross section, approximate trapezoidal shape. The two-part clamping element permits release of the plate by pressure (P) from the outer face of the cylinder (1) counter the force of a spring (8) which presses the clamping wedge parts (5, 6) towards the outside via a support plate (4). Preferably, the arrangement is symmetrical about a centerline (M) so that slight canting or tilting of the clamping wedges is possible for easy release of the plate (2) after installation. Upon rotation, centrifugal force acting on the clamping parts tightly clamps the printing plate (2) in position.

12 Claims, 1 Drawing Figure

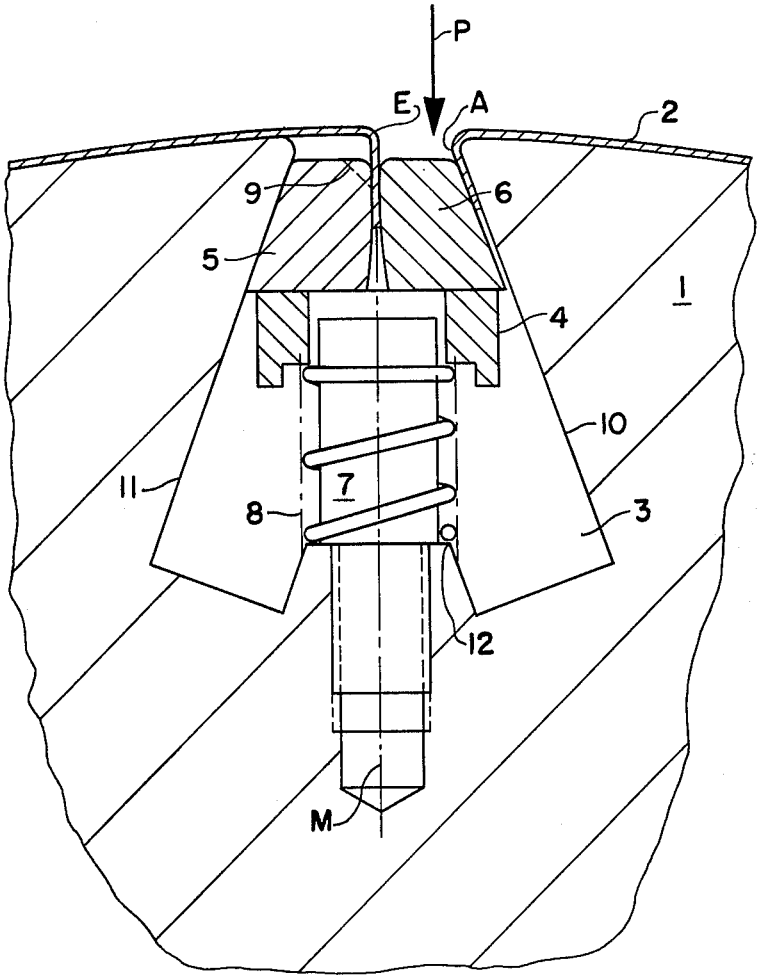
P
E
A
2
9
6
5
1
4
10
11
7
8
3
12
M

PRINTING PLATE ATTACHMENT SYSTEM

Reference to related application, the disclosure of which is hereby incorporated by reference, assigned to the assignee of the present application:

U.S. Ser. No. 260,686, filed May 5, 1981, now U.S. Pat. No. 4,376,414 by the inventors hereof.

The present invention relates to printing machines and more particularly to a system to attach a printing plate on a cylinder of a rotary printing machine, in which the cylinder has an axial groove to receive attachment elements.

BACKGROUND

Flexible printing plates can be attached to the plate cylinder of rotary printing machines in various ways. Many such plate cylinders have a groove, placed at the circumference of the cylinder and extending axially with respect thereto. An acute angle is formed between the walls of the groove and the circumference of the cylinder, the groove receiving a clamping spring arrangement to clamp the ends of the printing plate in the groove, the printing plate being wrapped around the remainder of the circumference of the plate cyclinder. As described in the referenced application Ser. No. 260,686, filed May 5, 1981, now U.S. Pat. No. 4,376,414, by the inventors hereof and titled "Printing Plate Attachment Arrangement", a clamping spring arrangement is provided which has two spring portions with clamping elements extending along at least part of one wall of the groove. The clamping elements are slidably held by wedge-shaped pressurized clamping bodies, which can clamp the ends of the printing plate against the wall of the groove. The two ends of the plate, thus, being clamped against the wall of the groove, are securely held within the attachment arrangement since, upon rotation of the plate cylinder, the clamping force increases due to centrifugal force acting on the wedge-shaped clamping elements tending to push them radially outwardly and hence in ever tighter engagement with the outwardly converging walls of the groove.

THE INVENTION

It is an object to improve a printing cylinder clamping arrangement which has the advantages of the structure of the aforementioned application, tight clamping and ease of insertion and manufacture, and which, additionally, permits loosening of the clamping arrangement, and thus ready removal of the printing plate from the outside, or cylindrical surface of the plate cylinder.

Briefly, a clamping body is provided which is made of two parts, one of them fitting against the side of the groove to clamp an end of the printing plate between the body and the wall of the groove. The other part fits between the wall of the groove, and receives the other end of the printing plate between that part and the first part. The first part will not be covered by the printing plate and is accessible from the circumference of the plate cylinder so that, for loosening thereof, pressure can be applied from the circumferential surface of the printing plate against the first clamping part, radially inwardly, and counter the centrifugal forces, upon rotation of the cylinder, to thereby permit loosening of the first end of the plate from the groove which, then, also permits removal of the plate at the second end.

The system has the advantage that the plate can be removed from the circumferential surface of the printing cylinder, and that removal tools or special arrangements to remove the plate, and to loosen the attachment arrangement otherwise accessible only from the end faces of the cylinders no longer are needed.

The system utilizes clamping elements which, in cross section, are frusto-conical and clamp the beginning and end strips or portions of the plate. One of the clamping parts is always accessible. The accessible part can be pushed radially inwardly by hand, by a screwdriver, a bar or the like, that is, any simple tool if it does not yield to hand pressure. Thus, removal of the plate is simple; likewise, attachment of the plate by first slipping the end portion against the wall of the groove in a particular part is simple, the part then being pressed outwardly by a spring.

DRAWING

The single FIGURE is a fragmentary cross sectional view through a printing press cylinder, illustrating the attachment groove for a printing plate, or similar element to be attached to the groove thereof, shown for an offset printing plate of a rotary offset printing machine.

The plate cylinder 1 has a plate 2 applied thereto, having a starting portion A and an end portion E. The starting and end portions are angled, so that they fit within the groove 3 of the cylinder 1. The groove 3 carries a clamping support plate 4 on which two clamping elements parts 5, 6 are seated. The clamping element parts are made as elongated elements, extending throughout the axial length of the cylinder. Their cross section is approximately trapezoidal. The part 5, 6 can also be attached to the support plate 4, which then forms a carrier therefor. One or more compression springs 8, shown only schematically in broken-line configuration, are provided, centered within the groove 3 by centering bolts 7. The spring or springs 8 engage the support plate 4 to urge the support plate 4 outwardly, and thus clamp the inclined wedge-faces of the clamping parts 5, 6 in engagement with the converging surfaces 10, 11 of the groove.

At least one of the clamping parts, for example the element 5, can be formed with a guide chamfer surface 9. Since this is not a necessary feature, the surface 9 is shown on broken lines. The chamfer surface facilitates introduction of the end portion E of the plate 2 between the parts 5, 6. If the printing plate 2 is reversely positioned, that is if the end A is placed at the left side (with respect to the FIGURE), then it is also desirable to form a similar chamfered surface at the other part 6.

The walls 10, 11 of the cylindrical groove converge towards the circumference of the cylinder 1 and form an acute angle with the surface of the cylinder.

A bore is formed in the bottom of the groove 3 to seat the bolt 7 therein. The bore can be tapped, so that bolt 7 can be threaded therein, seated with a shoulder against the bottom wall 12 of the groove 3.

The clamping elements are preferably symmetrically located with respect to a centerline or plane M.

Installation of a Printing Plate: The parts 5, 6 are depressed counter the force of the spring 8 downwardly with respect to the FIGURE, that is, radially inwardly with respect to the cylinder 1. The initial or starting portion A of the plate 2 is introduced in the small gap formed between part 6 and the inner wall 10 of groove 3. Symmetrical positioning of the elements of part 5, 6 permits slight tipping or tilting thereof so that they can be freely pushed inwardly into the cylinder. The support plate 4 is not strictly necessary if a suitable number of bolts 7 and springs 8 is used; it is preferred, however, since it provides for exact guidance and continuous axial support of the clamping elements 5, 6. Support plate 4 also can be tipped.

After insertion of the starting portion A, the plate 2 is wrapped around the circumference of the printing cylinder, for example by rotating the cylinder or otherwise. The end portion E then is placed in a small remaining gap between the parts 5, 6 or the parts are again depressed slightly to form such a gap. Use of the chamfered corner, as shown by line 9, facilitates introduction of the end portion and usually permits fitting of the end portion E between the parts 5, 6 without any additional tools, particularly if the plate 2 is rolled on the cylinder 1, for example by a cylinder in engagement therewith, such as the rubber blanket cylinder of a printing machine. Rolling-on a printing plate will fit the end E of the plate practically automatically between the clamping parts 5,6. The spring 8 ensures sufficient attachment of the end portions A and E of the plate 2 on the cylinder 1.

During printing and upon rotation of the cylinder, centrifugal force will tend to push the clamping parts 5, 6 outwardly and thus tightly clamp the plate 2 in position. The support plate 4, likewise, will be pushed outwardly and additionally cause clamping of parts 5, 6 so that the starting and end portions A and E of the plate 2 will be securely held against the wall 10, and between the parts 5, 6 respectively.

To remove the plate 2, that is to loosen the clamping arrangement, pressure can be applied in the direction of the pressure arrow P on the clamping wedge 6 which, in turn, will push against the support plate 4 to release the ends A, E of the plate 2 from clamped position on the cylinder.

Various changes and modifications may be made within the scope of the inventive concept.

We claim:

1. Printing cover attachment system for attachment of a cover element (2) to a cylinder (1) of a printing machine, in which the cylinder is formed with an axial groove (3) having outwardly converging side walls (10, 11), and outwardly spring-biased clamping wedge means (5, 6) are provided to clamp the end portions of the cover element (2) in position on the cylinder, wherein in accordance with the new invention the clamping wedge means comprises two essentially parallel parts (5, 6) extending axially in the groove, said parts having essentially trapezoidal cross section with an inclined surface facing against the inclined side walls (10, 11) and facing surfaces fitting essentially against each other;

and the cover element (2) is clamped with one end (A) between one inclined side wall (10) and the inclined surface of the adjacent clamping part (6) and with the other end (E) between the facing surfaces of both clamping parts (5, 6).

2. System according to claim 1, further including a support plate (4) positioned beneath the essentially parallel parts (5, 6) and loosely guided within the groove with clearance with respect to the walls of the groove to permit tipping of said support plate about a line or plane (M) extending symmetrically, centrally, from an outer circumference of the cylinder through the center of the groove (3).

3. System according to claim 2, further including at least one spring means (8) fitted against the bottom wall (12) of the groove and bearing against the support plate (4).

4. System according to claim 3, wherein the at least one spring means comprises a spiral compression spring;

and a guide bolt (7) is provided axially guiding the position of said compression spring, said guide bolt being secured to the bottom wall of the groove.

5. System according to claim 1, wherein at least one of said parallel parts (5, 6) is formed with an outer chamfered insertion surface relieving the corner defined by the essentially trapezoidal cross section at the facing surface with the other part to facilitate insertion of the other end (E) between the facing surfaces of both clamping parts.

6. System according to claim 1, further including at least one spring means (8) fitted against the bottom wall (12) of the groove and applying resilient pressure in an outward direction—with respect to the diameter of the cylinder (1)—against said essentially parallel parts (5, 6) to urge said parallel parts in an outward direction and to clamp the cover element in the groove (3).

7. System according to claim 6, wherein said at least one spring means comprises a spiral compression spring;

and a guide bolt (7) is provided, axially guiding the position of said compression spring, said guide bolt being secured in the groove.

8. System according to claim 2, wherein at least one of said parallel parts (5, 6) is formed with an outer chamfered insertion surface relieving the corner defined by the essentially trapezoidal cross section at the facing surface with the other part to facilitate insertion of the other end (E) between the facing surfaces of both clamping parts.

9. System according to claim 3, wherein at least one of said parallel parts (5, 6) is formed with an outer chamfered insertion surface relieving the corner defined by the essentially trapezoidal cross section at the facing surface with the other part to facilitate insertion of the other end (E) between the facing surfaces of both clamping parts.

10. System according to claim 4, wherein at least one of said parallel parts (5, 6) is formed with an outer chamfered insertion surface relieving the corner defined by the essentially trapezoidal cross section at the facing surface with the other part to facilitate insertion of the other end (E) between the facing surfaces of both clamping parts.

11. System according to claim 6, wherein at least one of said parallel parts (5, 6) is formed with an outer chamfered insertion surface relieving the corner defined by the essentially trapezoidal cross section at the facing surface with the other part to facilitate insertion of the other end (E) between the facing surfaces of both clamping parts.

12. System according to claim 7, wherein at least one of said parallel parts (5, 6) is formed with an outer chamfered insertion surface relieving the corner defined by the essentially trapezoidal cross section at the facing surface with the other part to facilitate insertion of the other end (E) between the facing surfaces of both clamping parts.

* * * * *